US006186427B1

(12) United States Patent
Toyoda et al.

(10) Patent No.: US 6,186,427 B1
(45) Date of Patent: Feb. 13, 2001

(54) MIXER

(75) Inventors: Kouji Toyoda; Hiroyuki Yamashita; Hideichi Nitta; Kenji Tanaka, all of Wakayama (JP)

(73) Assignee: Kao Corporation, Tokyo (JP)

( * ) Notice: Under 35 U.S.C. 154(b), the term of this patent shall be extended for 0 days.

(21) Appl. No.: 09/403,284

(22) PCT Filed: Apr. 22, 1998

(86) PCT No.: PCT/JP98/01832

§ 371 Date: Oct. 19, 1999

§ 102(e) Date: Oct. 19, 1999

(87) PCT Pub. No.: WO98/48929

PCT Pub. Date: Nov. 5, 1998

(30) Foreign Application Priority Data

Apr. 28, 1997 (JP) ..... 9-124892

(51) Int. Cl.[7] ..... B02C 18/22
(52) U.S. Cl. ..... 241/57; 241/101.8
(58) Field of Search ..... 241/57, 101.8, 241/199.12

(56) References Cited

U.S. PATENT DOCUMENTS 3,027,102 * 3/1962 Lodige et al. ..... 241/101.8
4,320,979 3/1982 Lucke .

FOREIGN PATENT DOCUMENTS 5-36493 9/1993 (JP) .
5-913249 3/1994 (JP) .
8-15538 2/1996 (JP) .

* cited by examiner

*Primary Examiner*—Mark Rosenbaum
(74) *Attorney, Agent, or Firm*—Birch, Stewart, Kolasch & Birch, LLP

(57) ABSTRACT

A mixing apparatus comprising a stirring member (4) and a flow direction-changing member (7), which are provided so as to rotate together with a rotating shaft (3) disposed to be drivable in a rotating manner around an axis inside a vessel (2) for containing a material to be mixed, and a pulverizing member (6) provided on the inner circumference (2*a*') of the vessel (2) facing the outer circumference of the rotating shaft (3) to be drivable in a rotating manner. The stirring member (4) is arranged by leaving a space relative to the outer circumference of the rotating shaft (3) in the radial direction of rotation, and has a stirring surface, which causes the material being mixed to flow toward the outer circumference of the rotating shaft (3). The flow direction-changing member (7) is provided by leaving a space relative to the inner circumference (2*a*') of the vessel (2) in the radial direction of rotation between the stirring surface and the outer circumference of the rotating shaft (3), and has a changing surface (7*d*'), which changes the direction of flow of the material being mixed from a direction toward the outer circumference of the rotating shaft (3) to a direction toward the inner circumference (2*a*') of the vessel (2).

8 Claims, 10 Drawing Sheets

Fig.9 ( 1 )
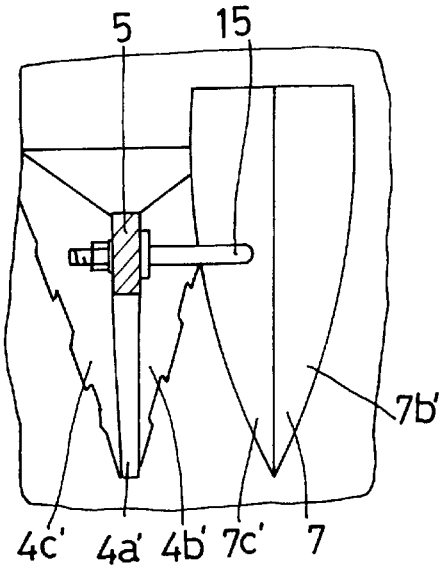
Fig.9 ( 2 )
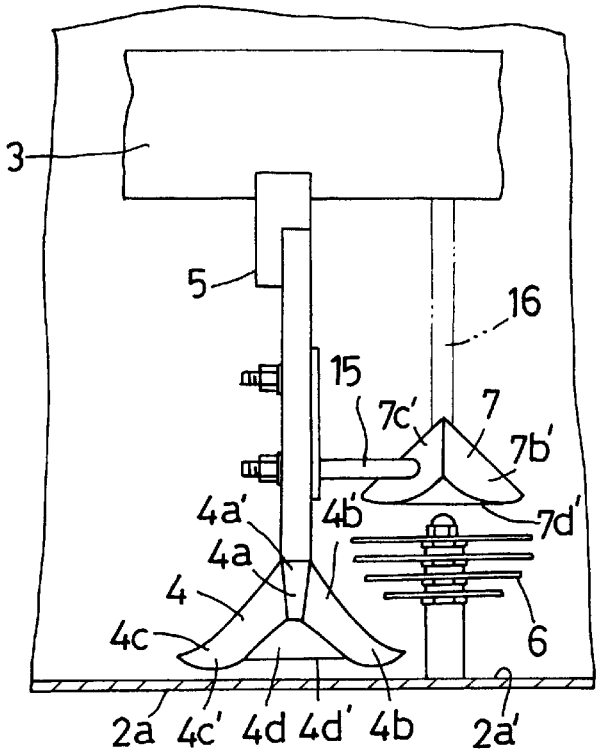
Fig.9 ( 3 )
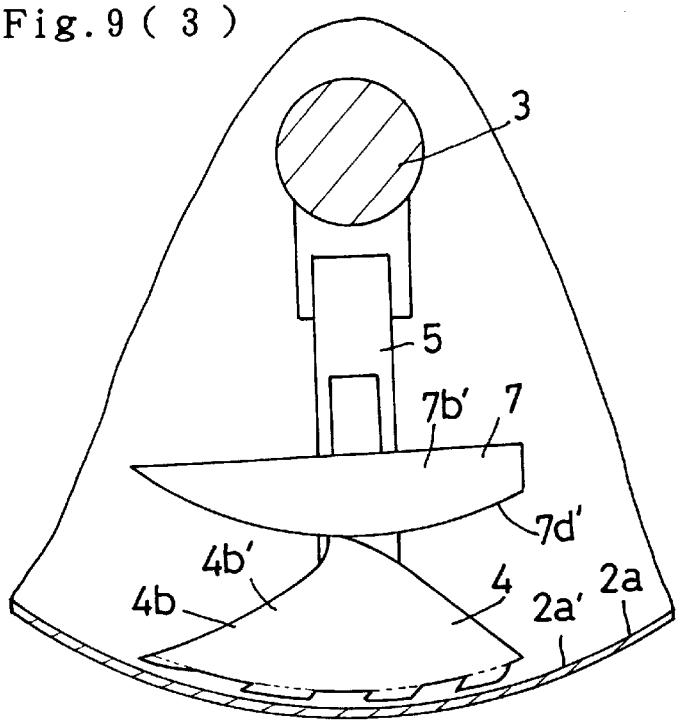

Fig.10 ( 1 )
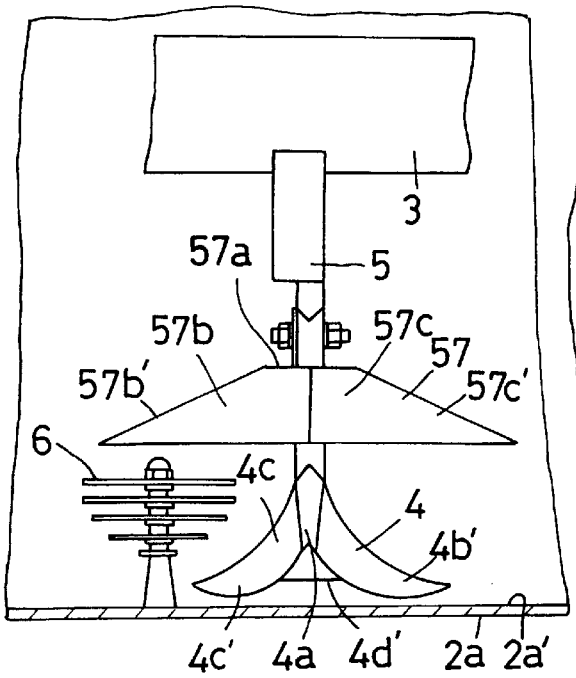
Fig.10 ( 3 )
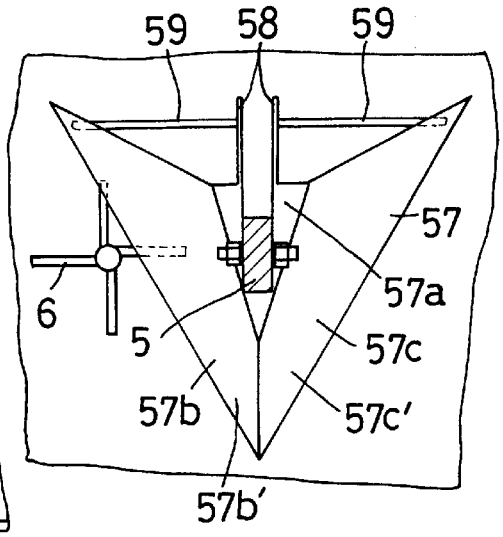
Fig.10 ( 2 )
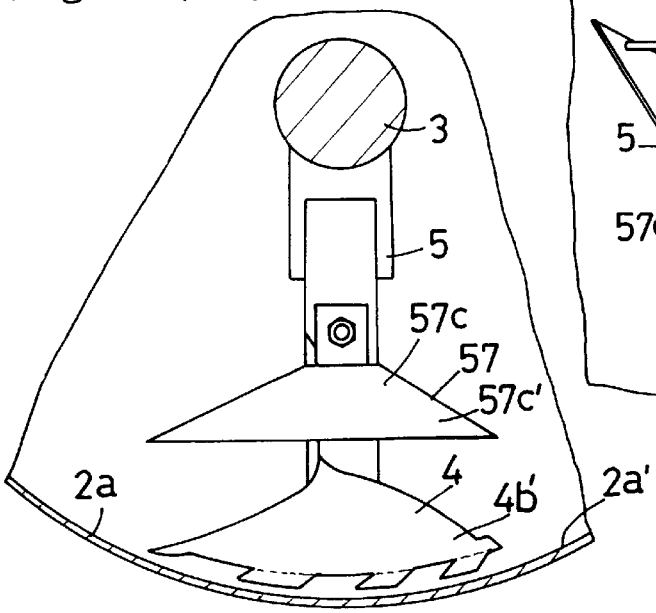
Fig.10 ( 4 )
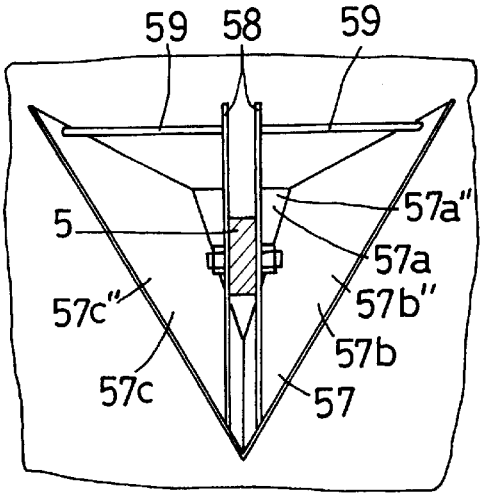

MIXER

This application is the national phase under 35 U.S.C. § 371 of PCT International Application No. PCT/JP98/01832 which has an International filing date of Apr. 22, 1998, which designated the United States of America.

TECHNICAL FIELD

The present invention is related to a mixing apparatus, which mixes a material to be mixed having fluidity, such as fine particles and a granular material, by stirring with a stirring member provided on a rotating shaft, which is driven in a rotating manner inside a vessel.

BACKGROUND ART

Japanese Examined Patent Publication SHO No. 59-13249 discloses a mixing apparatus comprising a vessel for a material to be mixed; a rotating shaft provided to be drivable in a rotating manner around an axis inside the vessel; and a plurality of stirring members provided so as to rotate together with the rotating shaft. With this prior art, the plurality of stirring members are arranged along the radial direction of rotation of the rotating shaft so as to enhance mixability by accelerating the flow of the material being mixed in the axial direction.

However, with this prior art, no pulverizing member is provided on the inner circumference of the vessel. Consequently, the aggregated mixture cannot be pulverized.

U.S. Pat. No. 4,320,979 discloses a mixing apparatus comprising a vessel for a material to be mixed; a rotating shaft provided to be drivable in a rotating manner around an axis inside the vessel; a first stirring member provided so as to rotate together with the rotating shaft; and a second stirring member provided so as to rotate together with the rotating shaft. The second stirring member has smaller radial direction dimensions than the first stirring member, and is arranged forwardly of the direction of rotation of the first stirring member, so that the load at mixing is reduced.

However, with this prior art, no pulverizing member is provided on the inner circumference of the vessel. Consequently, the aggregated mixture cannot be pulverized.

Japanese Examined Utility Model Publication HEI No. 5-36493 discloses a vessel for a material to be mixed; a rotating shaft provided to be drivable in a rotating manner around an axis inside the vessel; a stirring member provided so as to rotate together with the rotating shaft; and a pulverizing member provided on the inner circumference of the vessel to be drivable in a rotating manner. The stirring member is arranged by leaving a space relative to the outer circumference of the rotating shaft, and furthermore, has a stirring surface, which causes a material being mixed to flow toward the outer circumference of the rotating shaft. Further, it comprises an air jet nozzle for preventing a material being mixed from adhering to the inner circumference of the vessel. According to this prior art, the aggregated mixture can be pulverized with the pulverizing member.

However, with this prior art, whereas the pulverizing member is provided on the inner circumference of the vessel, the material being mixed flows toward the outer circumference of the rotating shaft. That is, because the material being mixed flowed in a direction away from the pulverizing member, mixture pulverizing efficiency was low.

Japanese Examined Patent Publication HEI No. 8-15538 discloses a vessel for a material to be mixed; a rotating shaft provided to be drivable in a rotating manner around an axis inside the vessel; a stirring member provided so as to rotate together with the rotating shaft; and a pulverizing member provided on the inner circumference of the vessel to be drivable in a rotating manner. The stirring member is arranged by leaving a space relative to the outer circumference of the rotating shaft, and has a stirring portion, which causes a material being mixed to flow toward the outer circumference of the rotating shaft. The pulverizing member is constituted of shearing rings, which rotate concentrically relative to each other. According to this prior art, the aggregated mixture can be pulverized with the pulverizing member.

However, with this prior art, the structure of the pulverizing member is complex. Further, whereas the pulverizing member is provided on the inner circumference of the vessel, the material being mixed flows toward the outer circumference of the rotating shaft. That is, because the material being mixed flowed in a direction away from the pulverizing member, mixture pulverizing efficiency was low.

Further, since the dimensions of the pulverizing member are restricted so as not to interfere with the stirring member, it was difficult to increase opportunities for contact between a material being mixed and the pulverizing member by using a conventional constitution.

The object of the present invention is to provide a mixing apparatus, which is capable of solving for the above problems.

DISCLOSURE OF THE INVENTION

The mixing apparatus of the present invention comprises a vessel for containing a material to be mixed; a rotating shaft provided to be drivable in a rotating manner around an axis inside the vessel; a stirring member provided so as to rotate together with the rotating shaft; a pulverizing member provided on the inner circumference of the vessel facing the outer circumference of the rotating shaft to be drivable in a rotating manner; and a flow direction-changing member provided so as to rotate together with the rotating shaft. The stirring member is arranged by leaving a space relative to the outer circumference of the rotating shaft in the radial direction of rotation, and has a stirring surface, which causes the material being mixed to flow toward the outer circumference of the rotating shaft. The flow direction-changing member is arranged by leaving a space relative to the inner circumference of the vessel in the radial direction of rotation, and has a changing surface which changes the direction of flow of the material being mixed from a direction toward the outer circumference of the rotating shaft to a direction toward the inner circumference of the vessel.

According to the mixing apparatus of the present invention, a material being mixed is stirred in accordance with the rotation of the stirring member, and the aggregated mixture is pulverized in accordance with the rotation of the pulverizing member. The material being mixed is made to flow toward the outer circumference of the rotating shaft by the stirring surface of the stirring member. The direction of flow of the material being mixed is made to change from a direction toward the outer circumference of the rotating shaft to a direction toward the inner circumference of the vessel by the changing surface of the flow direction-changing member. In accordance therewith, since the material being mixed is prevented from flowing in a direction away from the pulverizing member provided on the inner circumference of the vessel, and is concentrated toward the pulverizing member, it is possible to increase opportunities for contact between the material being mixed and the pulverizing member, and to enhance mixture pulverizing efficiency.

It is preferable that the rotating shaft is driven in a rotating manner around a horizontal axis, that the distance between at least a portion of the stirring surface and the outer circumference of the rotating shaft gradually increase forwardly of the direction of rotation, and also gradually increase on the way toward one end of the rotating shaft, and that the axis of rotation of the pulverizing member is arranged closer to one end of the rotating shaft than to at least a portion of the stirring surface.

According to this constitution, a material being mixed is made to flow toward one end of the rotating shaft as it flows toward the outer circumference of the rotating shaft by at least a portion of the stirring surface. Consequently, the direction of flow of a material being mixed is changed to a direction toward the inner circumference of the vessel, and to a direction toward one end of the rotating shaft by the changing surface. In accordance therewith, it is possible to increase opportunities for contact between the pulverizing member and the material being mixed at a location closer to one end of the rotating shaft than to at least one portion of the stirring surface, and to enhance mixture pulverizing efficiency of the pulverizing member. Further, the rotational resistance acting on the stirring member can be reduced.

In the mixing apparatus of the present invention, it is preferable that the changing surface has a portion which faces the pulverizing member in the radial direction of rotation partway through a rotation.

In accordance therewith, it is possible to increase opportunities for contact between the material being mixed and the pulverizing member, and to enhance pulverizing efficiency.

In the mixing apparatus of the present invention, it is preferable that the inner circumference of the vessel and the changing surface constitute curved surfaces, which parallel a rotating body which is coaxial with the rotating shaft.

In accordance therewith, since the distance between the inner circumference of the vessel main body and the changing surface is constant, the direction of flow of the material being mixed, which is introduced between the inner circumference and the changing surface, can be smoothly changed by the changing surface, making it possible to increase opportunities for contact between the material being mixed and the pulverizing member, and to enhance pulverizing efficiency.

It is preferable that the rotating shaft is driven in a rotating manner around a horizontal axis, that the distance between the stirring surface and the outer circumference of the rotating shaft gradually increases forwardly of the direction of rotation, and also gradually increases on the way toward one end of the rotating shaft, and that the changing surface has a portion, in which the dimensions in the axial direction of the rotating shaft gradually increase rearwardly of the direction of rotation.

According to this constitution, since a material being mixed is made to flow in a direction toward one end of the rotating shaft as it flows toward the outer circumference of the rotating shaft by the stirring surface, the material being mixed can be more efficiently pulverized with the pulverizing member as described above, and the rotational resistance acting on the stirring member can be reduced, enabling the material being mixed to be smoothly mixed. Moreover, since the changing surface has a portion, in which the dimensions in the axial direction of the rotating shaft gradually increase rearwardly of the direction of rotation, the changing surface can make efficient contact with the material being mixed, which flows toward one end of the rotating shaft as it flows toward the outer circumference of the rotating shaft, changing the direction of flow of the material being mixed.

In the mixing apparatus of the present invention, it is preferable that the rotating shaft is driven in a rotating manner around a horizontal axis, that the flow direction-changing member is arranged by leaving a space relative to the outer circumference of the rotating shaft in the radial direction of rotation, and that the flow direction-changing member has an auxiliary stirring surface of a shape, which is capable of causing the material being mixed to flow toward the outer circumference of the rotating shaft in accordance with rotation.

Causing the material being mixed to flow toward the outer circumference of the rotating shaft with the auxiliary stirring surface makes it possible to enhance stirring efficiency. The auxiliary stirring surface is provided on the flow direction-changing member, and is arranged by leaving a space relative to the outer circumference of the rotating shaft in the radial direction of rotation, the auxiliary stirring surface does not hinder the changing of the direction of flow of the material being mixed by the changing surface.

It is preferable that the mixing apparatus comprise means for ejecting a gas for conditioning the physical properties of the material being mixed inside the vessel, that the gas jet is provided in a fixed location relative to the vessel so as to enable the gas to be ejected from within the material being mixed during mixing, and that the gas is ejected forwardly of the direction of rotation of the stirring member. In accordance therewith, by ejecting the gas from within the material being mixed during mixing, and also, by ejecting the gas forwardly of the direction of rotation of the stirring member, it is possible to lengthen the residence time of the gas inside the material being mixed, and to efficiently condition the physical properties of the material being mixed with the gas. It is also preferable that the rotating shaft is driven in a rotating manner around a horizontal axis, that the inner circumference of the vessel constitute a curved surface, which parallels a rotating body which is coaxial with the rotating shaft, and that the gas jet is arranged so that the ejected gas flows upwardly along the inner circumference of the vessel from the lower portion of the vessel. In accordance therewith, even if the volume of the material to be mixed stored inside the vessel is much less than the capacity of the vessel, the residence time of the gas inside the material being mixed can be lengthened as much as possible, and the contact efficiency between the gas and the material being mixed can be enhanced.

According to the present invention, it is possible to provide a mixing apparatus with a simple structure, which is capable of enhancing pulverizing efficiency of the material being mixed and mixing performance, and which is also capable of efficiently conditioning the physical properties of the material being mixed with a gas.

BRIEF DESCRIPTION OF THE DRAWINGS

FIG. 9(1) is a partial plan view of a horizontal-type mixing apparatus of a third variation of the present invention, FIG. 9(2) is a partial front view of the horizontal-type mixing apparatus of the third variation of the present invention, and FIG. 9(3) is a partial side view of the horizontal-type mixing apparatus of the third variation of the present invention;

FIG. 10(1) is a partial front view of a horizontal-type mixing apparatus of a fourth variation of the present invention, FIG. 10(2) is a partial side view of the horizontal-type mixing apparatus of the fourth variation of the present invention, FIG. 10(3) is a partial plan view of the horizontal-type mixing apparatus of the fourth variation of the present invention, and FIG. 10(4) is a partial bottom view of the horizontal-type mixing apparatus of the fourth variation of the present invention;

BEST MODE FOR CARRYING OUT THE INVENTION

The embodiments of the present invention are described hereinbelow with reference to the figures.

Figure 1:
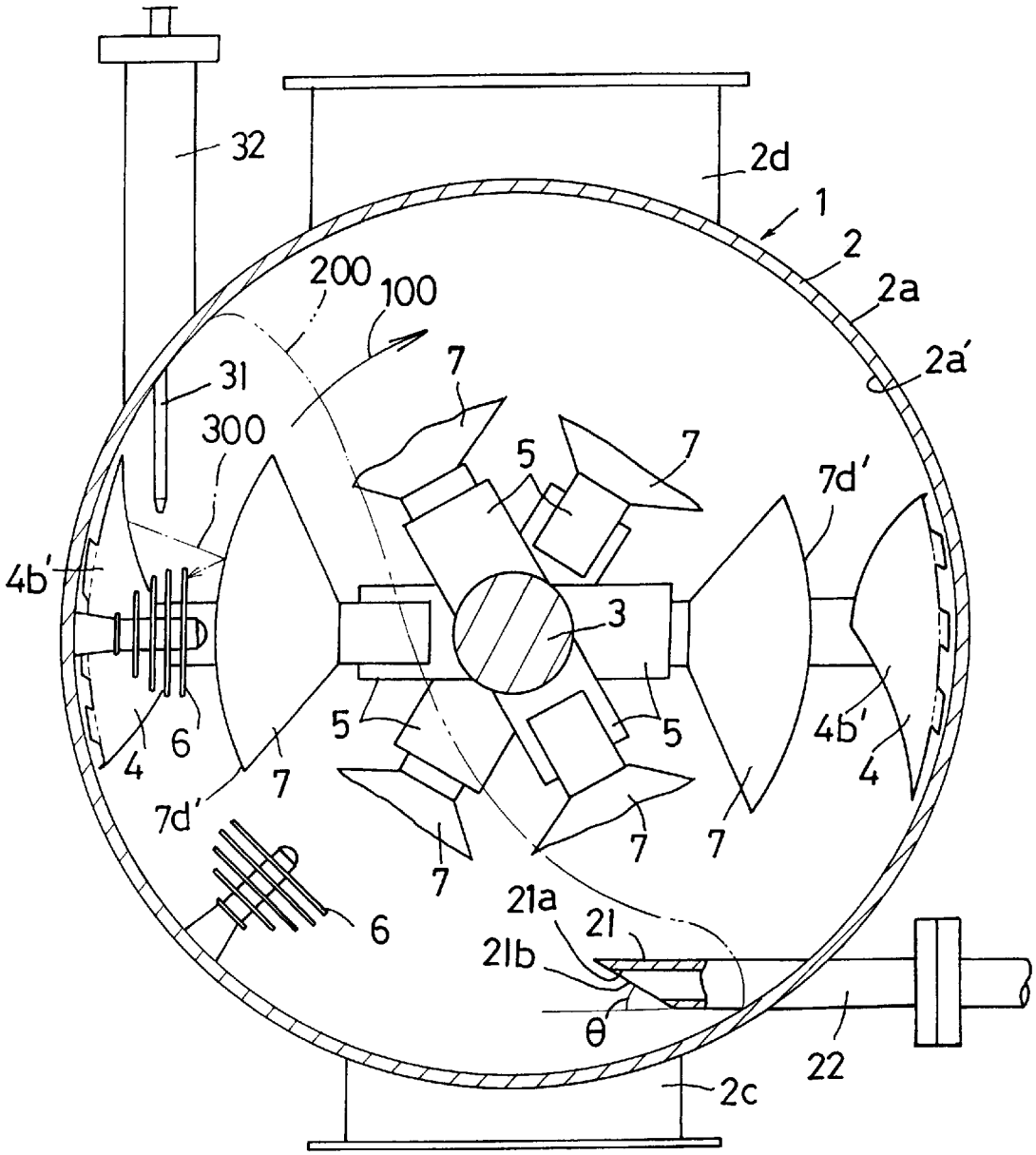
FIG. 1 is a side cross-sectional view of a horizontal-type mixing apparatus of an embodiment of the present invention.
Figure 2:
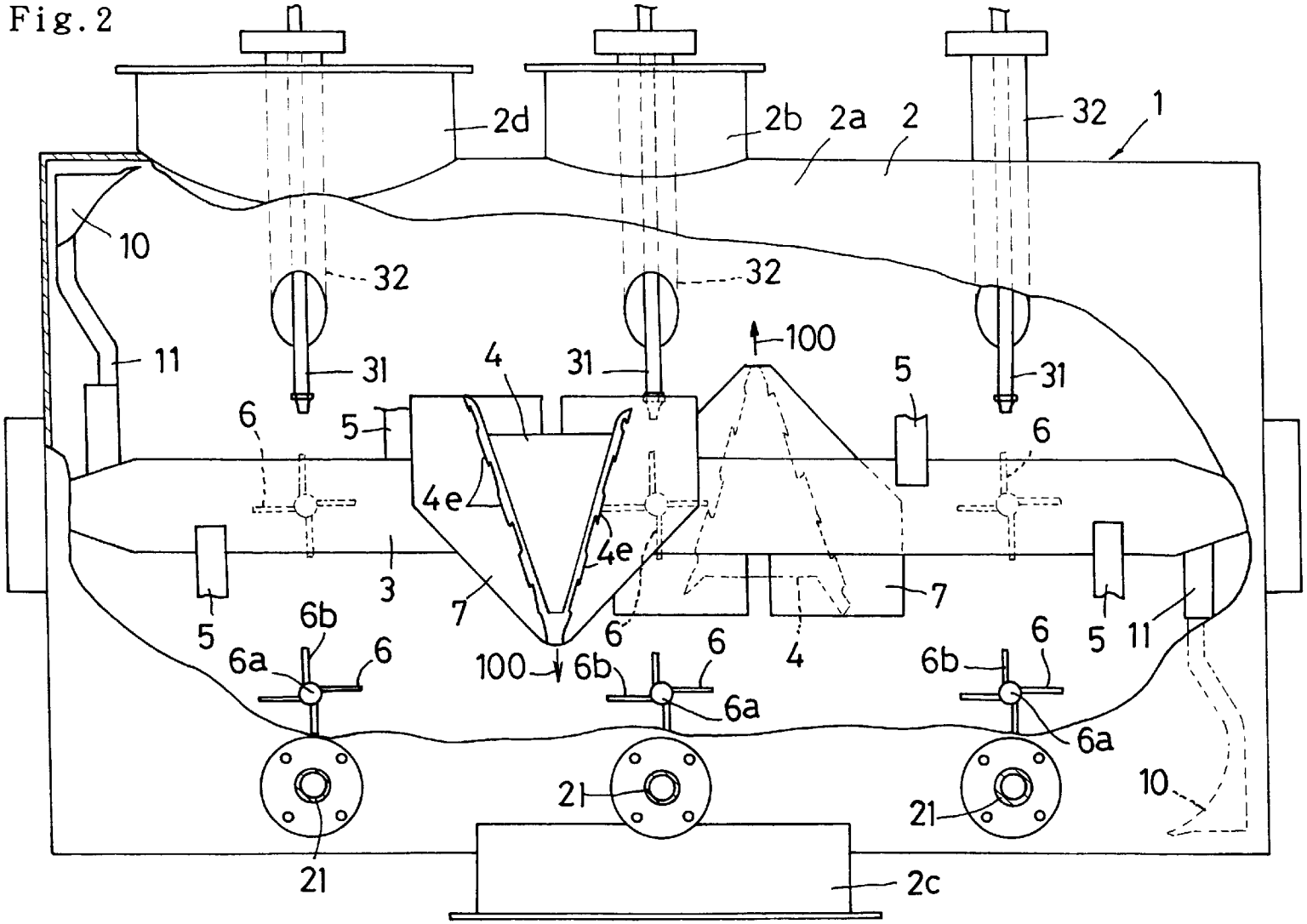
FIG. 2 is a partial front breakdown view of the horizontal-type mixing apparatus of the embodiment of the present invention.

The horizontal-type mixing apparatus 1 shown in FIG. 1, FIG. 2 comprises a vessel 2 for containing a material being mixed. This vessel 2 has a cylindrical-type vessel main body 2*a* having a horizontal central axis, an inlet portion 2*b* for the material to be mixed, a mixture discharge portion 2*c*, and an exhaust gas portion 2*d*.

Inside the vessel 2, a rotating shaft 3, which is capable of rotating around a horizontal axis with the same center as the axis of the vessel main body 2*a*, is supported at both ends. This rotating shaft 3 is driven in a rotating manner in the direction of arrow 100 in FIG. 1 by a driving source, such as a motor (omitted from the figure).

Six stirring members 4 are provided so as to rotate together with the rotating shaft 3 in the direction of arrow 100. In this embodiment, the stirring members 4 are arranged, for example, every 60 degrees in the direction of rotation at six mutually separate locations in the axial direction of the rotating shaft 3. In the figure, only two stirring members 4 of the center of the rotating shaft 3 are displayed; diagrams of the four stirring members 4 on the ends of the rotating shaft 3 have been omitted. The two stirring members 4 near the center of the rotating shaft 3 are arranged, for example, 180 degrees apart in the direction of rotation. The two stirring members near to one end of the rotating shaft 3 are arranged, for example, 180 degrees apart in the direction of rotation. The two stirring members near to the other end of the rotating shaft 3 are arranged, for example, 180 degrees apart in the direction of rotation. Each stirring member 4 is mounted to an arm 5, which protrudes from this rotating shaft 3. The number of stirring members 4 is not particularly limited.

Figure 3:
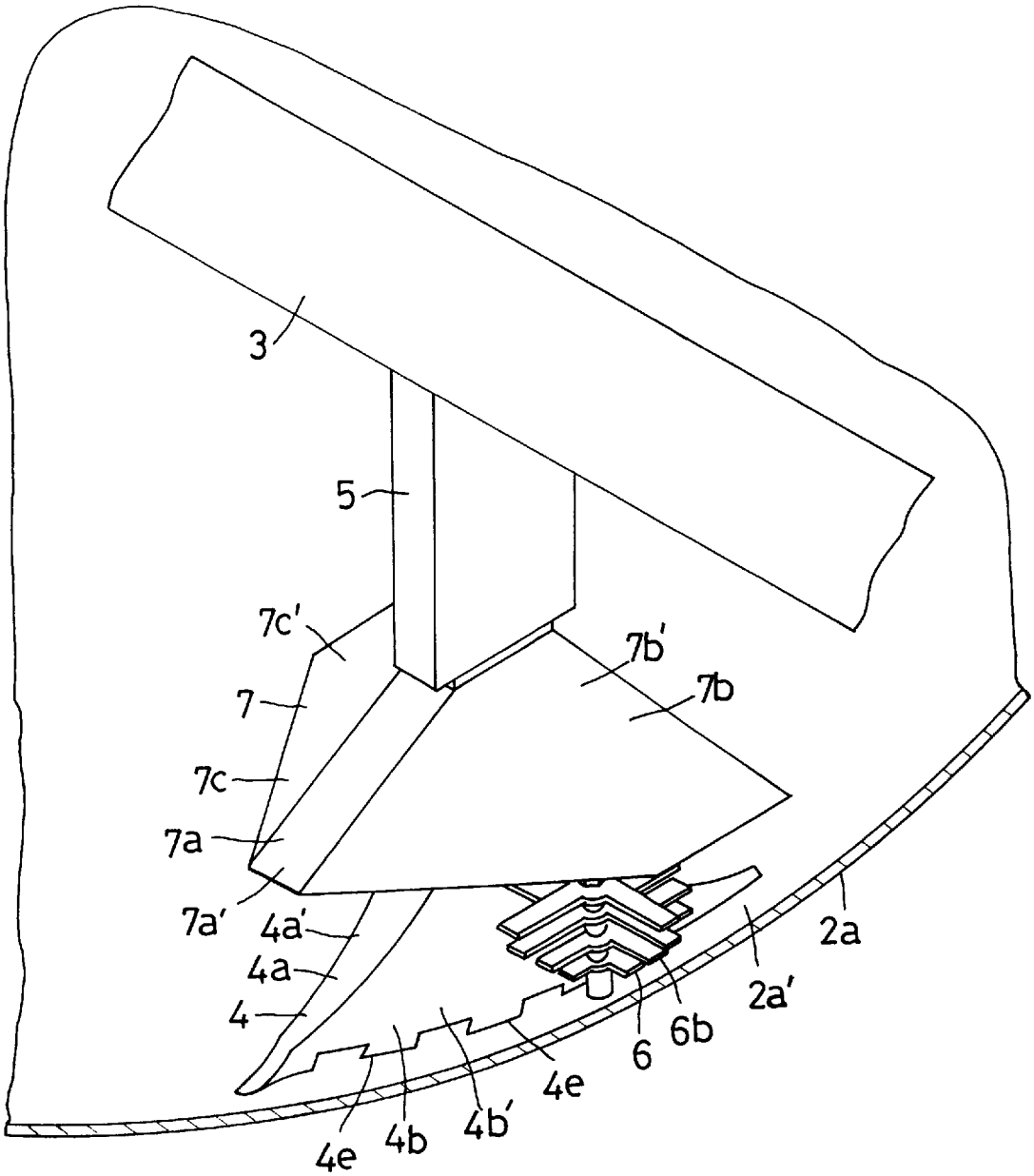
FIG. 3 is an oblique view of the principal portions of the horizontal-type mixing apparatus of the embodiment of the present invention.
Figure 4:
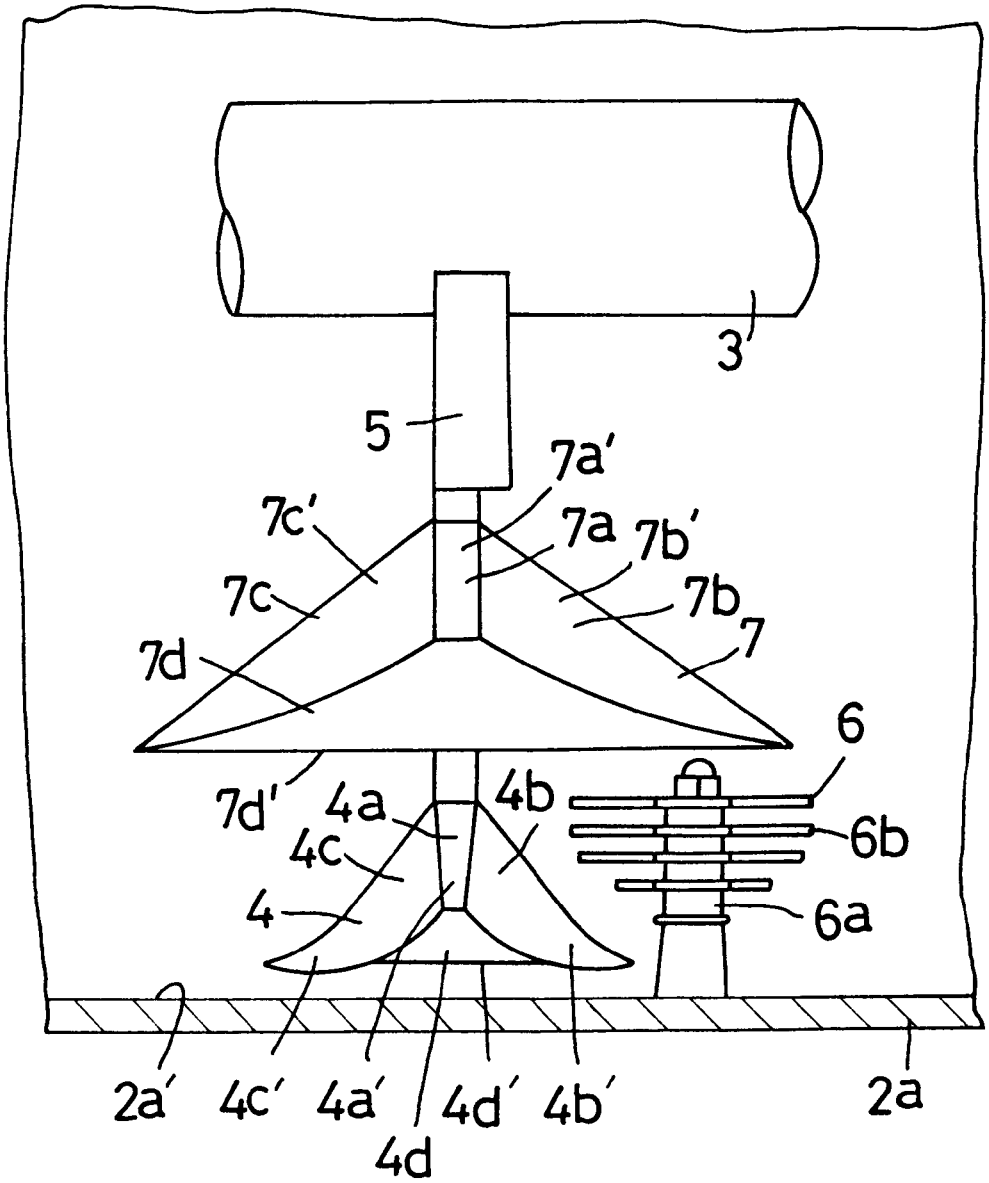
FIG. 4 is a front view of the principal portions of the horizontal-type mixing apparatus of the embodiment of the present invention.
Figure 5:
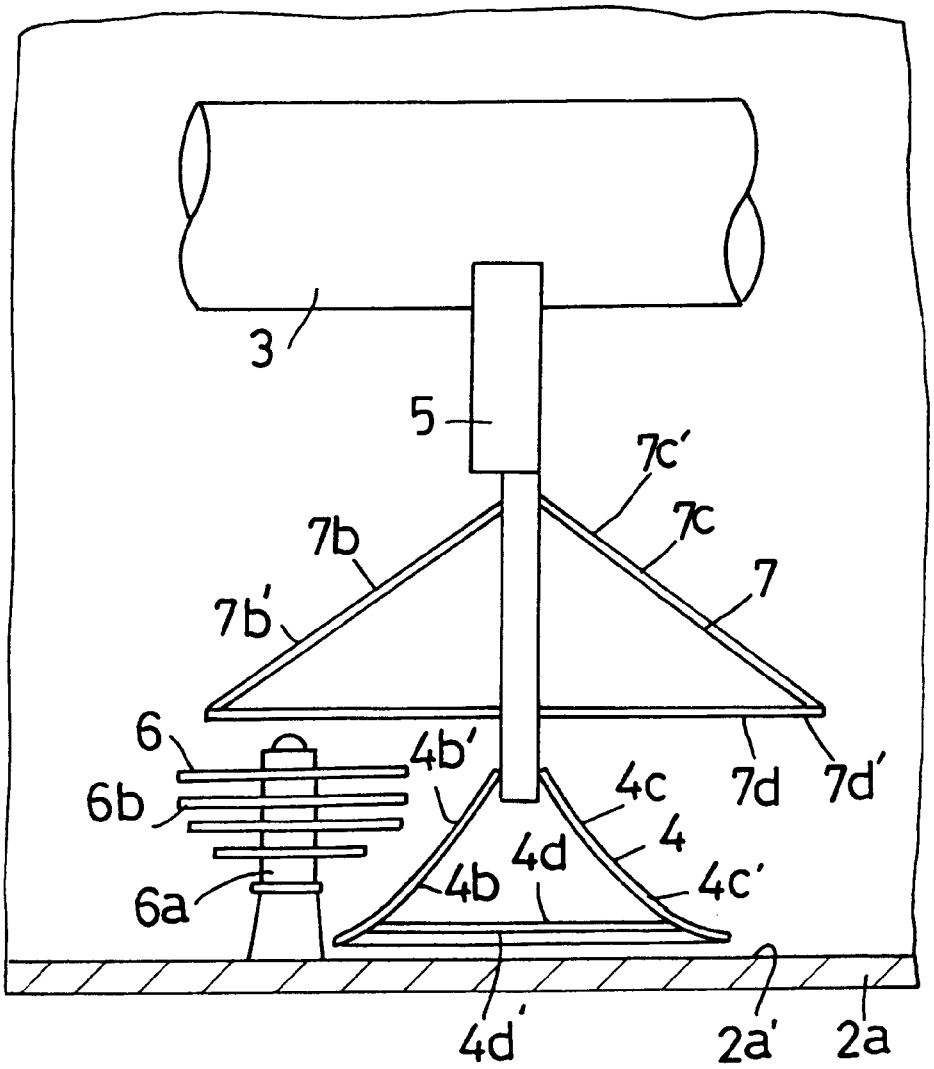
FIG. 5 is a rear view of the principal portions of the horizontal-type mixing apparatus of the embodiment of the present invention.
Figure 6:
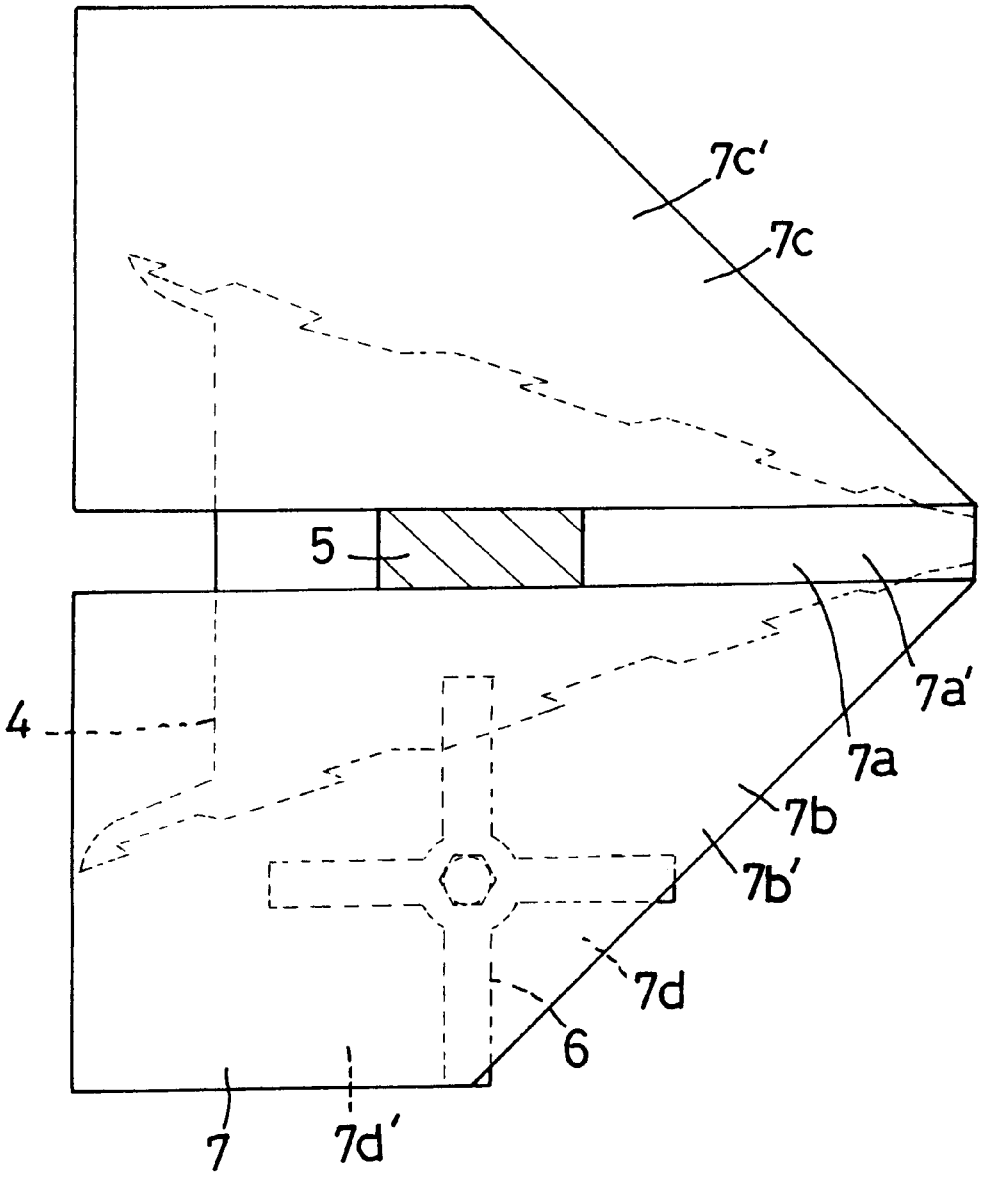
FIG. 6 is a plan view of the principal portions of the horizontal-type mixing apparatus of the embodiment of the present invention.

As shown in FIG. 3 through FIG. 5, each stirring member 4 has a plate-shaped front wall 4*a* located forwardly of the arm 5 in the direction of rotation thereof, a pair of plate-shaped side walls 4*b*, 4*c* located to the sides of the arm 5 in the axial direction of the rotating shaft 3, and a plate-shaped bottom wall 4*d* located outwardly of the side walls 4*b*, 4*c* in the radial direction of the rotating shaft 3.

The surface 4*a*' of the front wall 4*a* is arranged by leaving a space relative to the outer circumference of the rotating shaft 3 in the radial direction of rotation. The radial direction of rotation signifies the radial direction of the rotating shaft 3. The distance between the surface 4*a*' of the front wall 4*a* and the outer circumference of the rotating shaft 3 gradually increases forwardly of the direction of rotation.

The surface 4*b*' of one of the side walls 4*b* is arranged by leaving a space relative to the outer circumference of the rotating shaft 3 in the radial direction of rotation. The distance between the surface 4*b*' of this side wall 4*b* and the outer circumference of the rotating shaft 3 gradually increases forwardly of the direction of rotation, and also gradually increases on the way toward one end of the rotating shaft 3.

The surface 4*c*' of the other side wall 4*c* is arranged by leaving a space relative to the outer circumference of the rotating shaft 3 in the radial direction of rotation. The distance between the surface 4*c*' of this side wall 4*c* and the outer circumference of the rotating shaft 3 gradually increases forwardly of the direction of rotation, and also gradually increases on the way toward the other end of the rotating shaft 3.

The dimensions of each side wall 4*b*, 4*c* in the radial direction and axial direction of the rotating shaft 3 gradually increase rearwardly of the direction of rotation.

The surface 4*a*' of this front wall 4*a*, and the surfaces 4*b*', 4*c*' of each side wall 4*b*, 4*c* constitute the stirring surface, which causes a material being mixed to flow toward the outer circumference of the rotating shaft 3 in accordance with the rotation of the rotating shaft 3.

As shown in FIG. 2, FIG. 3, a plurality of teeth 4*e* are formed on the outer edge of each side wall 4*b*, 4*c* to reduce load during rotation. The teeth 4*e* can also be omitted.

The surface 4*d*' of the bottom wall 4*d* is arranged by leaving a space relative to the inner circumference 2*a*' of the vessel main body 2*a* in the radial direction of rotation, the inner circumference 2*a*' of the vessel main body 2*a* and the surface 4*d*' of the bottom wall 4*d* constitute curved surfaces, which parallel a rotating body which is coaxial with the rotating shaft 3, so that the space in the radial direction of rotation becomes constant. The rotating body is a circular cylinder in this embodiment, but so long as it is a rotating body, there are no limitations in particular.

Six pulverizing members 6 are provided on the inner circumference 2*a*' of the vessel main body 2*a*. Each pulverizing member 6 has a rotating shaft 6*a* capable of rotating around an axis, which parallels the radial direction of the vessel main body 2*a*, and a plurality of pulverizing blades 6*b*, which extend outwardly in the radial direction of rotation of the shaft 6*a* from this rotating shaft 6*a*, and is driven in a rotating manner by a driving source (omitted from the figure) such as a motor. Here, the radial direction of rotation signifies the radial direction of the rotating shaft 6*a*.

As shown in FIG. 2, in this embodiment, the pulverizing members 6 number in six, and are arranged by two in three separate locations in the axial direction of rotating shaft 3. The two pulverizing members 6 in each of the three separate locations in the axial direction of rotating shaft 3 are arranged apart from one another in the direction of rotation of rotating shaft 3.

That is, the rotating shafts of the two pulverizing members 6 arranged to the center in the axial direction of rotating shaft 3 are positioned closer to one end of rotating shaft 3 than to one of the stirring surfaces 4*b*' of one of the two stirring members 4 near to the center of rotating shaft 3, and are positioned closer to the other end of rotating shaft 3 than to another of the stirring surfaces 4*c*' of the other of the two stirring members 4 near to the center of rotating shaft 3.

The rotating shafts of the two pulverizing members 6 arranged near to the one end of rotating shaft 3 are positioned closer to one end of rotating shaft 3 than to one of the stirring surfaces 4*b*' of one of the two stirring members 4 near to one end of rotating shaft 3, and are positioned closer to the other end of rotating shaft 3 than to another of the stirring surfaces 4*c*' of the other of the two stirring members 4 near to one end of rotating shaft 3.

The rotating shafts of the two pulverizing members 6 arranged near to the other end of rotating shaft 3 are positioned closer to one end of rotating shaft 3 than to one of the stirring surfaces 4*b*' of one of the two stirring members 4 near to the other end of rotating shaft 3, and are positioned closer to the other end of rotating shaft 3 than to another of the stirring surfaces 4*c*' of the other of the two stirring members 4 near to the other end of rotating shaft 3.

The configuration height of three pulverizing members 6 is set at roughly ½ the height of the vessel main body 2*a*. The configuration height of the other three pulverizing members 6 is set so as to be arranged between the bottom portion and ½ the height of the vessel main body 2*a*. The number of pulverizing members 6 is not limited in particular.

Six flow direction-changing members 7 are provided so as to rotate together with the rotating shaft 3. In this embodiment, each flow direction-changing member 7 faces, in a one-to-one manner, each of the above-mentioned stirring members 4. That is, each flow direction-changing member 7 is mounted to an above-mentioned arm 5 so as to be arranged between each stirring member 4 and the rotating shaft 3. The number of flow direction-changing members 7 is not particularly limited.

As shown in FIG. 3 through FIG. 6, each flow direction-changing member 7 has a plate-shaped front wall 7*a* located forwardly of the arm 5 in the direction of rotation thereof, a pair of plate-shaped side walls 7*b*, 7*c* located to the sides of the arm 5 in the axial direction of the rotating shaft 3, and a plate-shaped bottom wall 7*d* located outwardly of the side walls 7*b*, 7*c* in the radial direction of rotation of the rotating shaft 3.

The surface 7*a*' of the front wall 7*a* is arranged by leaving a space relative to the outer circumference of the rotating shaft 3 in the radial direction of rotation, and this space in the radial direction of rotation gradually increases forwardly of the direction of rotation.

The surface 7*b*' of one of the side walls 7*b* is arranged by leaving a space relative to the outer circumference of the rotating shaft 3 in the radial direction of rotation, and this space in the radial direction of rotation gradually increases forwardly of the direction of rotation and gradually increases on the way toward one end of the rotating shaft 3.

The surface 7*c*' of the other side wall 7*c* is arranged by leaving a space relative to the outer circumference of the rotating shaft 3 in the radial direction of rotation, and this space in the radial direction of rotation gradually increases forwardly of the direction of rotation and gradually increases on the way toward the other end of the rotating shaft 3.

The surface 7*a*' of the front wall 7*a*, and the surfaces 7*b*', 7*c*' of each side wall 7*b*, 7*c* constitute an auxiliary stirring surface, which causes the material being mixed to flow toward the outer circumference of the rotating shaft 3 in accordance with the rotation of the rotating shaft 3.

The dimensions of each side wall 7*b*, 7*c* in the radial direction and axial direction of the rotating shaft 3 gradually increase rearwardly of the direction of rotation, becoming constant thereafter.

The surface of the bottom wall 7*d* is arranged by leaving a space relative to the inner circumference 2*a*' of the vessel main body 2*a* in the radial direction of rotation between the above-mentioned stirring surface 4*a*', 4*b*', 4*c*' and the outer circumference of the rotating shaft 3, and constitutes a changing surface 7*d*', which changes the direction of flow of the material being mixed from a direction toward the outer circumference of the rotating shaft 3 to a direction toward the inner circumference 2*a*' of the vessel main body 2*a*.

The inner circumference 2*a*' of the vessel main body 2*a* and the changing surface 7*d*' constitute curved surfaces, which parallel a rotating body which is coaxial with the rotating shaft 3, so that the space in the radial direction of rotation between the inner circumference 2*a*' of the vessel main body 2*a* and the changing surface 7*d*' becomes constant. The rotating body is a circular cylinder in this embodiment, but is not particularly limited to this shape.

The changing surface 7*d*' has a portion, which faces the above-mentioned stirring surface 4*a*', 4*b*', 4*c*' across a space in the radial direction of rotation. In this embodiment, the dimensions of the changing surface 7*d*' in the direction of rotation are roughly equivalent to the dimensions of the stirring member 4 in the direction of rotation. The dimensions of the changing surface 7*d*' in the axial direction of the rotating shaft 3 are larger than the dimensions of the stirring member 4 in the axial direction of the rotating shaft 3. In accordance therewith, the changing surface 7*d*' covers the entire stirring surface 4*a*', 4*b*', 4*c*' in the radial direction of rotation.

It is desirable that the maximum dimensions in the direction of rotation of the changing surface 7*d*' is equivalent to, or larger than, the maximum dimensions in the direction of rotation of the stirring member 4 so as to enable coverage of the entire stirring surface 4*a*', 4*b*', 4*c*'. It is desirable that the front end position of the changing surface 7*d*' in the direction of rotation either correspond to the stirring member 4, or is arranged further rearwardly of the direction of rotation than the front end position of the stirring member 4 in the direction of rotation. It is desirable that the rear end position of the changing surface 7*d*' in the direction of rotation either correspond to the stirring member 4, or is arranged further rearwardly of the direction of rotation than the rear end position of the stirring member 4 in the direction of rotation.

The changing surface 7*d*' has a portion, which faces the above-mentioned pulverizing member 6 entirely in the radial direction of rotation partway through a rotation. That is, the changing surfaces 7*d*' of two flow direction-changing members 7 near to the center of the rotating shaft 3 face two pulverizing members 6 positioned to the center of the rotating shaft 3 in the radial direction of rotation partway through a rotation. The changing surfaces 7*d*' of two flow direction-changing members 7 near to one end of the rotating shaft 3 face two pulverizing members 6 positioned near to the one end of the rotating shaft 3 in the radial direction of rotation partway through a rotation. The changing surfaces 7*d*' of two flow direction-changing members 7 near to the other end of the rotating shaft 3 face two pulverizing members 6 positioned near to the other end of the rotating shaft 3 in the radial direction of rotation partway through a rotation.

As shown in FIG. 2, two auxiliary stirring members 10 are arranged at two locations close to either end of the rotating shaft so as to rotate together with the rotating shaft 3. These two auxiliary stirring members 10 are arranged, for example, 180 degrees apart to each other in the direction of rotation. Each auxiliary stirring member 10 is mounted to an arm 11, which protrudes from the rotating shaft 3, and are provided close to the outer circumference of the vessel main body 2*a*. The shape of each auxiliary stirring member 10 is not particularly limited so long as the material being mixed can be stirred. Further, a plurality of auxiliary stirring members 10 can be provided at the same location.

As shown in FIG. 1, FIG. 2, three pipes 21 are provided inside the vessel main body 2*a* for ejecting a gas, which is utilized to condition the moisture content, temperature, composition, and other physical properties of the material being mixed. For example, dry air or inert gas is ejected to condition the moisture content of the material being mixed; temperature-controlled air or inert gas is ejected to condition the temperature of the material being mixed; and a reactive gas is ejected to condition the composition of a material being mixed via a reaction.

In this embodiment, these gas supply pipes 21 are provided in three locations spaced along the axial direction of the rotating shaft 3. That is, each pipe 21 is provided in a fixed location relative to the vessel main body 2*a* by being inserted inside the vessel main body 2*a*, and secured using welding or some other well-known securing method. A gas jet 21*a*, which is constituted of the opening at the end of each pipe 21, is arranged at a fixed location relative to the vessel main body 2*a* so as to eject a gas from within the material being mixed during mixing. The volume of the material being mixed stored in the vessel main body 2*a* is set at less than the capacity of the vessel main body 2*a*. The two-dot chain line 200 in FIG. 1 shows one example of the surface position of a material being mixed during the mixing thereof. The number of gas jets 21*a* is not particularly limited.

The gas from each gas jet 21*a* is ejected forwardly of the direction of rotation of the above-mentioned stirring member 4. Furthermore, each gas jet 21*a* is arranged close to the bottom portion of the vessel main body 2*a* so that the ejected gas flows upwardly from the lower portion of the vessel main body 2*a* along the inner circumference 2*a*' of the vessel main body 2*a*.

The end 21*b* of each pipe 21 is inclined relative to the horizontal plane so as to go rearwardly of the direction of rotation of a stirring member 4 with going downward. The angle θ formed by the end 21*b* of the pipe 21 and the horizontal plane is set at less than the angle of repose of the powdered material being mixed.

The location of each gas jet 21*a* in the axial direction of the rotating shaft 3 corresponds to the location of each of the above-mentioned pulverizing members 6 in the axial direction of the rotating shaft 3. That is, relative to a gas jet 21*a* arranged to the center of the rotating shaft 3, two pulverizing members 6 arranged to the center of the rotating shaft 3 are positioned forwardly of the direction of rotation of the stirring member 4 in the material being mixed during stirring. Relative to a gas jet 21*a* arranged near to one end of the rotating shaft 3, two pulverizing members 6 arranged near to one end of the rotating shaft 3 are positioned forwardly of the direction of rotation of the stirring member 4 in the material being mixed during stirring. Relative to a gas jet 21*a* arranged near to the other end of the rotating shaft 3, two pulverizing members 6 arranged near to the other end of the rotating shaft 3 are positioned forwardly of the direction of rotation of the stirring member 4 in the material being mixed during stirring.

Three pipes 31 are provided for supplying a liquid to the inside of the vessel main body 2*a*. As this liquid, there is supplied, for example, a granulating liquid for granulating the powdered material being mixed, and a reactive liquid, which generates a chemical reaction when brought in contact with the material being mixed.

In this embodiment, these liquid supply pipes 31 are provided in three locations spaced along the axial direction of the rotating shaft 3. That is, each pipe 31 is arranged in a fixed location relative to the vessel main body 2*a* by being inserted inside the vessel main body 2*a* via a cylindrical guide body 32 mounted to the vessel main body 2*a*, and secured to this guide body 32. In this embodiment, a liquid discharge opening, which is constituted of the opening at the end of each pipe 31, is arranged at a fixed location relative to the vessel main body 2*a* so as to be able to downwardly discharge a liquid from within the material being mixed during mixing. A liquid downwardly discharged from each liquid supply pipe 31 moves rearwardly of the direction of rotation of the above-mentioned stirring member 4 in this embodiment. A plurality of pipes 31 can be provided at the same location.

The locations of the liquid discharge openings of these liquid supply pipes 31 in the axial direction of the rotating shaft 3 correspond to the locations of the above-mentioned pulverizing members 6 in the axial direction of the rotating shaft 3. That is, a pulverizing member 6 located to the center of the rotating shaft 3 at roughly ½ the height of the vessel main body 2*a* is opposite to a liquid discharge opening located to the center of the rotating shaft 3. A pulverizing member 6 located near to one end of the rotating shaft 3 at roughly ½ the height of the vessel main body 2*a* is opposite to a liquid discharge opening located near to one end of the rotating shaft 3. A pulverizing member 6 located near to the other end of the rotating shaft 3 at roughly ½ the height of the vessel main body 2*a* is opposite to a liquid discharge opening located to the other end of the rotating shaft 3. In accordance therewith, each pulverizing member 6 located at roughly ½ the height of the vessel main body 2*a* also serves as a dispersing member, which disperses a liquid supplied from each pipe 31. The locations of the dispersing members 6 in the axial direction of the rotating shaft 3 correspond to the locations of the above-mentioned gas jets 21*a* in the axial direction of the rotating shaft 3.

According to the above mixing apparatus, the mixing of the material to be mixed is performed by stirring with the stirring member 4. Further, the aggregated mixture is pulverized in accordance with the rotation of the pulverizing member 6. The material being mixed is made to flow toward the outer circumference of the rotating shaft 3 by the stirring surface 4*a*', 4*b*', 4*c*' of the stirring member 4 thereof. The one-dot chain line 300 in FIG. 1 shows the direction of flow of the material being mixed. The direction of flow of the material being mixed is made to change from a direction toward the outer circumference of the rotating shaft 3 to a direction toward the inner circumference 2*a*' of the vessel main body 2*a* by the changing surface 7*d*' of the flow direction-changing member 7. Accordingly, the material being mixed can be prevented from flowing in a direction away from the pulverizing member 6 located on the inner circumference 2*a*' of the vessel main body 2*a*. In accordance therewith, opportunities for contact between the material being mixed and the pulverizing member 6 can be increased, and the material being mixed can be pulverized more efficiently.

Further, by one stirring surface 4*b*' of each stirring member 4, the material being mixed can be made to flow so as to move toward one end of the rotating shaft 3 in accordance with moving toward the outer circumference of the rotating shaft 3. Accordingly, by the changing surface 7*d*' which faces the stirring surface 4*b*', the direction of flow of the material being mixed can be changed to a direction toward the inner circumference 2*a*' of the vessel main body 2*a*, and to a direction toward one end of the rotating shaft 3. In accordance therewith, opportunities for contact between the material being mixed and the pulverizing member 6 can be increased at a location closer to one end of the rotating shaft 3 than to the stirring surface 4*b*', and the material being mixed can be pulverized more efficiently by the pulverizing member 6.

Since each changing surface 7*d*' has a portion, which faces the pulverizing member 6 in the radial direction of rotation partway through a rotation, it is possible to increase opportunities for contact between the material being mixed and the pulverizing member 6, and to enhance pulverizing efficiency.

Since the inner circumference 2*a*' of the vessel main body 2*a*, and the changing surface 7*d*' are constituted as curved surfaces, which parallel a rotating body which is coaxial with the rotating shaft 3, the distance between the inner circumference 2*a*' of the vessel main body 2*a* and the changing surface 7*d*' becomes constant. In accordance therewith, the direction of flow of the material being mixed introduced between the inner circumference 2*a*' and changing surface 7*d*' can be smoothly changed by the changing surface 7*d*', making it possible to increase opportunities for contact between the material being mixed and the pulverizing member, and to enhance pulverizing efficiency.

Since the changing surface 7*d*' has a portion, the dimensions in the axial direction of the rotating shaft 3 of which are gradually increased rearwardly of the direction of rotation, the changing surface 7*d*' can make efficient contact with a material being mixed which is flowing toward one end of the rotating shaft 3 in accordance with flowing toward the outer circumference of the rotating shaft 3, making it possible to change the direction of flow of the material being mixed.

According to the above constitution, it is possible to enhance stirring efficiency by making the material being mixed flow toward the outer circumference of the rotating shaft 3 by auxiliary stirring surface 7*a*', 7*b*', 7*c*'. Since the auxiliary stirring surfaces 7*a*', 7*b*', 7*c*' are provided on the flow direction-changing member 7, and are arranged by leaving a space relative to the outer circumference of the rotating shaft 3 in the radial direction of rotation, the auxiliary stirring surface 7*a*', 7*b*', 7*c*' does not impede the changing surface 7*d*' from changing the direction of flow of a material being mixed. The space in the radial direction of rotation between the auxiliary stirring surface 7*a*', 7*b*', 7*c*' and the outer circumference of the rotating shaft 3 gradually increases forwardly of the direction of rotation, and also gradually increases on the way toward one end of the rotating shaft 3.

Since the above-mentioned gas jet 21*a* ejects a gas forwardly of the direction of rotation of the stirring member 4 from within the material being mixed during mixing, the residence time of the gas inside the material being mixed can be lengthened, making it possible to efficiently condition the properties of the material being mixed, i.e. to dry or cool the material being mixed with the gas. The gas jet 21*a* is arranged so that the ejected gas flows upwardly along the inner circumference of the vessel from the lower portion of the vessel main body 2*a*. In accordance therewith, even if the volume of the material being mixed stored in the vessel main body 2*a* is much less than the capacity of the vessel main body 2*a*, the residence time of the gas inside the material being mixed can be lengthened as long as possible, making it possible to enhance the contact efficiency between the gas and the material being mixed. Since the angle θ formed between the end 21*b* of the pipe 21, which constitutes the gas jet 21*a*, and the horizontal plane is less than the angle of repose of the powdered material to be mixed, it is possible to prevent the material being mixed from entering inside the pipe 21. The location of each gas jet 21*a* in the axial direction of the rotating shaft 3 corresponds to the location of each of the above-mentioned pulverizing members 6 in the axial direction of the rotating shaft 3. No stirring member 4 passes through the circumferential area of the vessel main body 2*a*, where the pulverizing member 6 is located, so as not to interfere with the pulverizing member 6. Consequently, the location of each gas jet 21*a* in the axial direction of the rotating shaft 3 corresponds to the location of each of the above-mentioned pulverizing members 6 in the axial direction of the rotating shaft 3, and the material being mixed is prevented from residing in an area, where no stirring member 4 passes through, by the gas ejected from each gas jet 21*a*; and the material being mixed flows toward the pulverizing member 6, pulverizing the material being mixed more efficiently. Furthermore, causing a gas to flow to a location, in which a liquid from the liquid supply pipe 31 is supplied in a concentrated manner, can enhance the contact efficiency between the gas and the material being mixed in the liquid supply location. In accordance therewith, it is possible to efficiently condition the properties of the material being mixed, i.e. to dry or to cool the material being mixed with the gas.

The present invention is not limited to the above embodiment.

Figure 7:
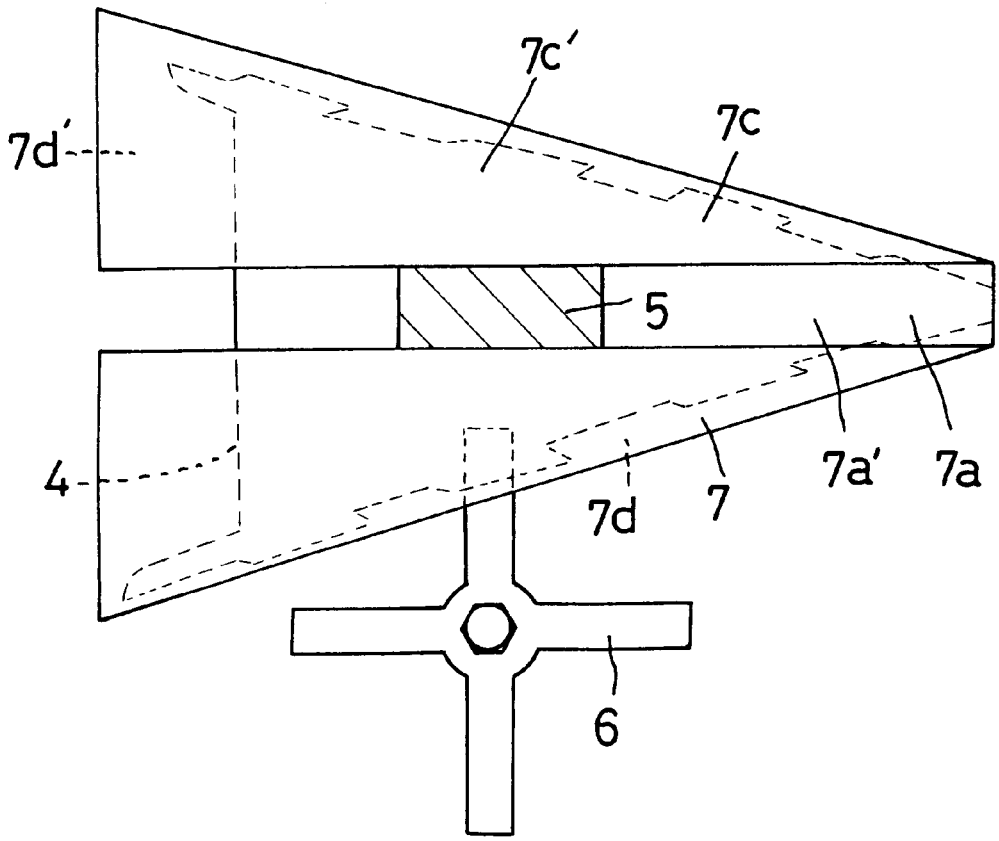
FIG. 7 is a partial plan view of a horizontal-type mixing apparatus of a first variation of the present invention.

For example, as shown in a first variation of FIG. 7, the changing surface 7*d*' can have a portion, which faces only a portion of the pulverizing member 6 in the radial direction of rotation partway through a rotation.

Figure 8:
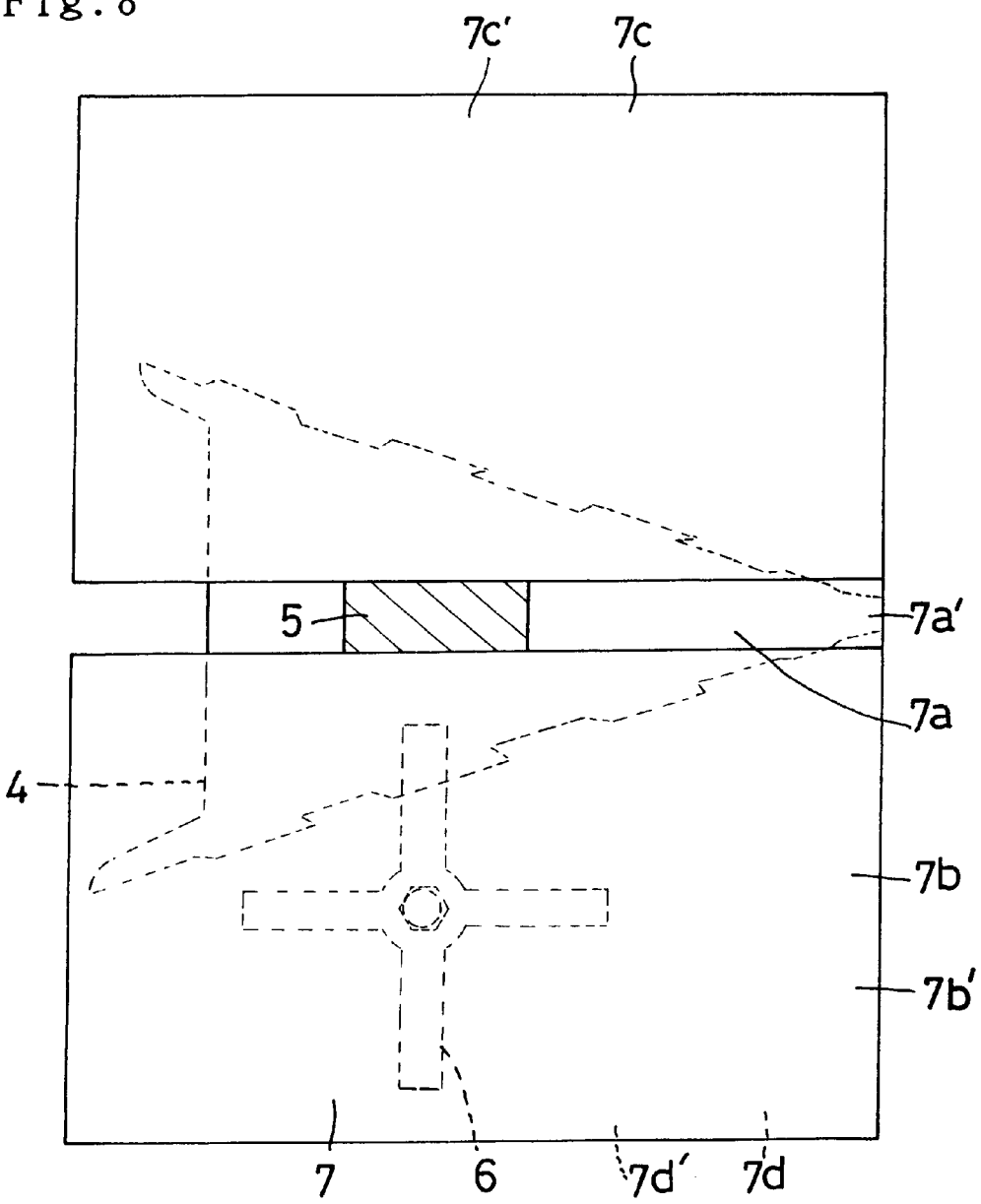
FIG. 8 is a partial plan view of a horizontal-type mixing apparatus of a second variation of the present invention.

Further, the dimensions of the changing surface 7*d*' in the axial direction of the rotating shaft 3 can gradually increase rearwardly of the direction of rotation from its front end to rear end, as shown in the first variation of FIG. 7, or can be constant in the overall area of the direction of rotation, as shown in a second variation of FIG. 8.

In the above embodiment, the flow direction-changing member 7 is mounted directly to the arm 5, but as shown in a third variation of FIGS. 9(1), (2), (3), the flow direction-changing member 7 can be mounted to an auxiliary arm 15, which protrudes from the arm 5 in the axial direction of the rotating shaft 3, and as indicated by the two-dot chain lines in FIG. 9(2), the flow direction-changing member 7 can also be mounted to a second arm 16, which protrudes from the rotating shaft 3. In short, the flow direction-changing member 7 can be provided so as to be able to rotate together with the rotating shaft 3.

Further, it is not necessary for the changing surface 7*d*' to be provided in a location, in which it overlaps the stirring surface 4*a*', 4*b*', 4*c*' in the radial direction of the rotating shaft 3, but rather can be provided in a location, in which there exists material being mixed, which is flowing toward the outer circumference of the rotating shaft 3 in accordance with being stirred by the stirring surface 4*a*', 4*b*', 4*c*'. In the above embodiment, the changing surface 7*d*' constitutes a convex curved surface, which parallels a rotating body which is coaxial with the rotating shaft 3, but the shape is not particularly limited. For example, a flow direction-changing member 57 shown in a fourth variation of FIGS. 10(1), (2), (3), (4), has a plate-shaped top wall 57*a*, which is parallel to the axis of rotation of the rotating shaft 3, and a pair of plate-shaped side walls 57*b*, 57*c*, which are located on either side of an arm 5 in the axial direction of the rotating shaft 3, and the surfaces 57*b*', 57*c*' of the two side walls 57*b*, 57*c* constitute an auxiliary stirring surface similar to the above embodiment. The dimensions of each side wall 57*b*, 57*c* in the axial direction and radial direction of the rotating shaft 3 gradually increase rearwardly of the direction of rotation. The rear surface of each side wall 57*b*, 57*c* is connected to a pair of reinforcing plates 58 mounted to the arm 5, and reinforcing rods 59 protruding from the reinforcing plates 58 are connected to the side walls 57*b*, 57*c*. The back side surface 57*a*" of the top wall 57*a*, and the back side surfaces 57*b*", 57*c*" of each side wall 57*b*, 57*c* are used as a changing surface. Alternatively, a plate-shaped bottom wall can be provided outwardly from the two side walls 57*b*, 57*c* in the radial direction of rotation of the rotating shaft 3, and a flat changing surface can be provided on this bottom wall.

In the above-mentioned first through third variations, the other portions are the same as the above embodiment, and the same portions as the above embodiment are indicated by the same reference numerals.

In the above embodiment, one stirring member faces one flow direction-changing member, but one stirring member can face a plurality of flow direction-changing members, or a plurality of stirring members can face one flow direction-changing member.

In the above embodiment, the present invention applies to a horizontal-type mixing apparatus 1, but the present invention can also be applied to a vertical-type mixing apparatus, wherein the rotating shaft rotates around a vertical axis.

What is claimed is:

1. A mixing apparatus, comprising:

a vessel for containing a material to be mixed;

a rotating shaft provided to be drivable in a rotating manner around an axis inside the vessel;

a stirring member provided so as to rotate together with the rotating shaft;

a pulverizing member provided on the inner circumference of the vessel facing the outer circumference of the rotating shaft to be drivable in a rotating manner; and a flow direction-changing member provided so as to rotate together with the rotating shaft, wherein the stirring member is arranged by leaving a space relative to the outer circumference of the rotating shaft in the radial direction of rotation, and has a stirring surface, which causes the material being mixed to flow toward the outer circumference of the rotating shaft; and the flow direction-changing member is arranged by leaving a space relative to the inner circumference of the vessel in the radial direction of rotation, and has a changing surface, which changes the direction of flow of the material being mixed from a direction toward the outer circumference of the rotating shaft to a direction toward the inner circumference of the vessel.

2. The mixing apparatus according to claim 1, wherein:

the rotating shaft is driven in a rotating manner around a horizontal axis;

the distance between at least a portion of the stirring surface and the outer circumference of the rotating shaft gradually increases forwardly of the direction of rotation, and also gradually increases on the way toward one end of the rotating shaft; and the axis of rotation of the pulverizing member is arranged closer to one end of the rotating shaft than to at least a portion of the stirring surface.

3. The mixing apparatus according to claim 1, wherein the changing surface has a portion which faces the pulverizing member in the radial direction of rotation partway through a rotation.

4. The mixing apparatus according to claim 1, wherein the inner circumference of the vessel and the changing surface constitute curved surfaces, which parallel a rotating body which is coaxial with the rotating shaft.

5. The mixing apparatus according to claim 1, wherein:

the rotating shaft is driven in a rotating manner around a horizontal axis;

the distance between the stirring surface and outer circumference of the rotating shaft gradually increases forwardly of the direction of rotation, and also gradually increases on the way toward one end of the rotating shaft; and the changing surface has a portion, in which the dimensions in the axial direction of the rotating shaft gradually increase rearwardly of the direction of rotation.

6. The mixing apparatus according to claim 1, wherein:

the rotating shaft is driven in a rotating manner around a horizontal axis; and the flow direction-changing member is arranged by leaving a space relative to the outer circumference of the rotating member in the radial direction of rotation, and has an auxiliary stirring surface of a shape, which is capable of causing the material being mixed to flow toward the outer circumference of the rotating shaft in accordance with rotation.

7. The mixing apparatus according to claim 1, further comprising:

means for ejecting a gas for conditioning the physical properties of the material being mixed inside the vessel, and wherein the gas jet is provided in a fixed location relative to the vessel so as to enable the gas to be ejected from within the material being mixed during mixing, and the gas is ejected forwardly of the direction of rotation of the stirring member.

8. The mixing apparatus according to claim 7, wherein:

the rotating shaft is driven in a rotating manner around a horizontal axis;

the inner circumference of the vessel constitutes a curved surface, which parallels a rotating body which is coaxial with the rotating shaft; and the gas jet is arranged so that the ejected gas flows upwardly along the inner circumference of the vessel from the lower portion of the vessel.

* * * * *